United States Patent [19]

Renda

[11] 4,205,542

[45] Jun. 3, 1980

[54] ALARM TYPE LOCK ASSEMBLY

[75] Inventor: Joseph Renda, Montreal, Canada

[73] Assignee: Lawrence Peska Associates, Inc., New York, N.Y. ; a part interest

[21] Appl. No.: 863,423

[22] Filed: Dec. 22, 1977

[51] Int. Cl.[2] ..... E05B 39/00

[52] U.S. Cl. ..... 70/434; 70/441; 70/DIG. 49

[58] Field of Search ..... 70/363, 364 A, 419, 70/421, 434, 441, DIG. 49; 200/44, 61.66, 42 R; 340/274

[56] References Cited

U.S. PATENT DOCUMENTS

| | | | |
|---|---|---|---|
| 2,057,301 | 10/1936 | Golokow | 70/364 A |
| 2,095,819 | 10/1937 | Lefebvre | 200/61.66 |
| 3,724,245 | 4/1973 | Kitchen | 70/4.31 |
| 3,878,700 | 4/1975 | Lopez | 70/363 |
| 3,986,376 | 10/1976 | Lack | 70/364 A |

*Primary Examiner*—Robert L. Wolfe

[57] ABSTRACT

Alarm type lock assembly comprising a cylinder having a core rotatably disposed therein, a key slot extending through the core, a plurality of bores extending into the key slot, tumblers disposed in the bores and spring biased to a first position in which the tumblers prevent rotative movement of the core, a key adapted to enter the slot and operative to move the tumblers to a second position to permit rotative movement of the core, and contact points aligned with the tumblers and in circuit with an alarm means, the tumblers being movable to a third position in which the tumblers engage the contact points to energize the alarm means and prevent opening operation of the lock.

5 Claims, 2 Drawing Figures

ALARM TYPE LOCK ASSEMBLY

BACKGROUND OF THE INVENTION

1. Field of the Invention

This invention relates to security devices and is directed more particularly to an improved lock assembly structure adapted to energize an alarm signal upon abnormal manipulation of the lock.

2. Description of the Prior Art

Patents have shown the combinations of locks and switches for producing a signal if an unauthorized attempt is made to operate the lock, either by picking or by a key other than the proper key. Examples of such combinations may be seen in U.S. Pat. Nos.: 653,132; 2,057,301; 3,348,220; 3,444,546; 3,587,081; 3,596,014; 3,723,677; and 3,797,004.

SUMMARY OF THE INVENTION

An object of the present invention is to provide a lock which is resistant to "picking" and which provides means for sounding an alarm in the event of an attempt to pick the lock or open the lock with an improper key.

A further object of the invention is to provide such a device as is relatively non-complex and inexpensive to manufacture and convenient and easy to use.

With the above and other objects in view, as will hereinafter appear, a feature of the present invention is the provision of an alarm type lock assembly comprising a cylinder having a core rotatably disposed therein, a key slot extending lengthwise through the core, a plurality of bores extending into the key slot and generally normal thereto, tumblers disposed in the bores and spring biased to a first position in which the tumblers extend into the slot to a point at which the tumblers prevent rotative movement of the core in the cylinder, a key device adapted to enter the slot and having cam surfaces thereon engageable with the tumblers to move the tumblers to a second position in which the tumblers have shear lines coincident with the juncture of the core and the cylinder, whereby to permit rotative movement of the core in the cylinder, and contact points aligned with the tumblers and in electrical circuit with an alarm means, the tumblers being movable to a third position in which the tumblers engage the contact points to energize the alarm means and the shear lines are removed from the juncture to prevent opening operation of the lock.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

DESCRIPTION OF THE PREFERRED EMBODIMENT

Figure 1:
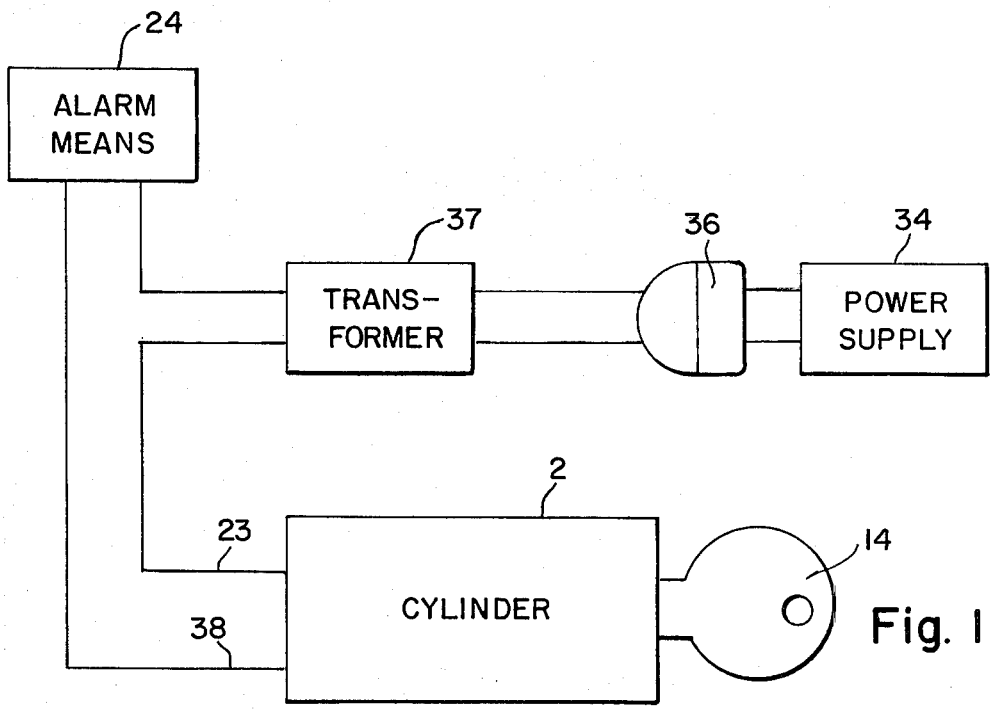
FIG. 1 is a diagrammatic representation of an electrical circuit illustrative of an embodiment of the invention.

Referring to the drawings, it will be seen that the illustrative alarm type lock comprises a cylinder 2 having a core 4 rotatably disposed therein. A key slot 6 extends lengthwise through the core 4 and is in communication with a plurality of bores 8 which extend into the key slot and are disposed generally normal thereto.

Tumblers 10 are disposed in the bores 8 and are biased by spring means 12 to a first position in which the tumblers extend into the slot 6 to a point at which the tumblers prevent rotative movement of the core 4 in the cylinder 2, as will be further described below.

A key device 14 is adapted to enter the slot 6 and is provided with cam surfaces 16 engageable with the tumblers 10 to move the tumblers to a second position in which the tumblers have shear lines 18 coincident with the juncture 20 of the core 4 and the cylinder 2, whereby to permit rotative movement of the core in the cylinder.

Contact points 22 are aligned with each tumbler 10 and are disposed in an electrical circuit 23 having an alarm means 24 therein. The tumblers 10 are movable to a third position in which the shear lines 18 are not coincident with the juncture 20, thereby preventing rotative movement of the core 4 in a cylinder 2, and in which the tumblers 10 make contact with the contact points 22 to close the circuit 23 and energize the alarm means 24, which may be a bell, siren, and/or flashing light, or the like.

Each of the tumblers 10 comprise a pin 26 and a driver 28, the pin 26 being adapted to engage the cam surfaces 16 of the key device 14 and being in end-to-end abutment with its corresponding driver 28.

Figure 2:
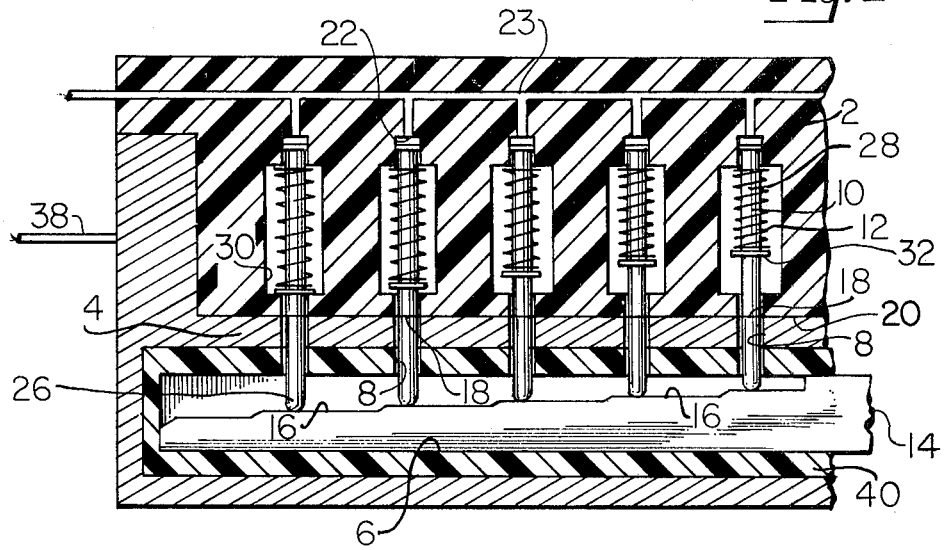
FIG. 2 is an elevational sectional view of one form of lock means illustrative of an embodiment suitable for use in the invention.

Referring particularly to FIG. 2, it will be seen that the cylinder 2 is provided with a plurality of chambers 30, each of the chambers 30 being in alignment with one of the bores 8 and having one of the drivers 28 disposed therein. Each of the drivers 28 has collar means 32 fixed thereon within the confines of the chamber 30. The spring means 12 is also disposed in the chamber 30 and preferably comprises a coil spring disposed about the driver 28 and bearing against the collar means 32 to urge the driver 28 in a direction toward the slot 6. Each of the contact points 22 is disposed in one of the bores 8 and is in alignment with an end of the driver 28 remote from the pin 26.

The cam surfaces 16 of the key device 14 are of such configuration as to place the shear lines 18 of the tumblers 10 in a position coincident with the juncture 20 of the cylinder 2 and core 4 so that the core may be rotated relative to the cylinder when the key device is fully inserted in the slot. The shear lines 18 are defined by the junctures of the drivers 28 and the pins 26.

The electrical circuit 23 includes a power supply 34 or, alternatively, a connection means 36 adapted for connection to the power source 34 and a transformer 37. An electrical lead 38 is connected to the core 4 and constitutes a portion of the electrical circuit 23. The bottom half of core 4 is preferably of electrically conductive material, as are the pins 26 and drivers 28. The top half of cylinder 2 is of electrically insulative material. The key slot 6 is provided with a liner 40 of electrically insulative material. Thus, when a tumbler 10 contacts a contact point 22 a circuit is closed including the electrical circuit 23, the pertinent contact point 22, the pertinent tumbler 10, the core 4, and the electrical lead 38.

In use, an attempt to pick the lock of the present invention will usually result in a tumbler 10 being forced upwardly against a contact point 22 to energize the alarm 24. Further, attempted picking of the lock, or use of the wrong key, will result in an improper alignment of the shear lines 18 with the juncture 20, thereby negating any possible rotative movement of the core relative to the cylinder. Thus tampering with the lock or attempted use of a wrong key, will result in the lock not opening and also in the sounding of the alarm.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. Alarm type lock assembly comprising a cylinder having a core disposed therein and rotatable therein about a lengthwise axis, said core having a key slot therein extending axially thereof, said cylinder and said core having bores therein, each bore of said cylinder being alignable with a corresponding bore of said core, said core bores extending into said key slot, the axes of said bores being generally normal to the axis of said key slot, each of said bores of said cylinder having an enlarged portion defining a chamber, tumblers disposed in said bores, a collar fixed to each of said tumblers and disposed in one of said chambers, a coil spring disposed in each of said chambers, said coil spring being disposed about one of said tumblers and having one end thereof abutting one of said collars to bias said tumblers to a first position in which said tumblers extend into said key slot to a point to which said tumblers prevent rotative movement of said core in said cylinder, a substantially flat elongated key device adapted to enter said slot and having cam surfaces disposed upon an elongated axially extending surface thereof engageable with said tumblers serially upon introduction of said key to said slot to move said tumblers to a second position in which said tumblers have shear lines coincident with the juncture of said core and said cylinder, whereby to permit said rotative movement of said core in said cylinder, and a contact point aligned with each of said tumblers and in electrical circuit with an alarm means, each of said tumblers being movable to a third position in which said tumblers engage their respective contact points to energize said alarm means and said shear lines are removed from said juncture to prevent opening operation of said lock, said key device being inoperative to move said tumblers to said third position.

2. The invention in accordance with claim 1, in which said tumblers each comprise a pin and a driver, each of said pins being engageable with said cam surfaces of said key device and being in end-to-end alignment with one of said drivers.

3. The invention in accordance with claim 2 in which said contact points are each disposed in each one of said cylinder bores and in alignment with an end of said driver remote from said pin.

4. The invention in accordance with claim 3 in which said shear lines comprise junctures of said drivers and said pins.

5. The invention in accordance with claim 4 in which said cam surfaces of said key device are of stepped configuration and are operative to place said shear lines at said coincident position with said juncture of said core and said cylinder when said key device is fully inserted in said slot, each of said pins being engaged with a different planar step of said key device.

* * * * *